US005691500A

United States Patent [19]

Mancini

[11] Patent Number: 5,691,500

[45] Date of Patent: Nov. 25, 1997

[54] REMOTELY-ACTUATED FIREWORKS LAUNCHER APPARATUS

[76] Inventor: Massimiliano Mancini, 6341 E. Norma Lee, W. Bloomfield, Mich. 48322

[21] Appl. No.: 514,486

[22] Filed: Aug. 11, 1995

[51] Int. Cl.[6] ..... F42B 4/04

[52] U.S. Cl. ..... 102/361; 102/336; 102/338; 102/352; 102/361

[58] Field of Search ..... 102/336, 338, 102/352, 361

[56] References Cited

U.S. PATENT DOCUMENTS

| | | | |
|---|---|---|---|
| 2,532,901 | 12/1950 | Glynn | 246/215 |
| 3,292,302 | 12/1966 | Estes et al. | 46/74 |
| 4,325,304 | 4/1982 | Ormiston | 102/200 |
| 4,641,580 | 2/1987 | Ogatsu | 102/217 |
| 4,729,319 | 3/1988 | Orlando | 102/351 |
| 4,771,695 | 9/1988 | Simpson | 102/343 |
| 4,917,015 | 4/1990 | Lowery | 102/342 |
| 4,964,331 | 10/1990 | Halevy et al. | 89/37.19 |
| 5,282,455 | 2/1994 | Adamson et al. | 124/59 |
| 5,339,741 | 8/1994 | Craven et al. | 102/361 |

*Primary Examiner*—Peter A. Nelson

[57] ABSTRACT

A remotely-actuated fireworks launcher apparatus includes a housing assembly, a signal receiver housed within the housing assembly, an ignition servo electrically connected to the signal receiver and housed with the housing assembly, and a servo-actuated ignition switch operated by the ignition servo. The servo-actuated ignition switch is in an ignition circuit which also includes an electric igniter assembly, and a power supply. A fireworks receiver assembly is attached to the electric igniter assembly. The fireworks receiver assembly receives a fireworks device that is ignited by the electric igniter assembly. A manually operated ignition signal transmitter is actuated to transmit signals for activation of the signal receiver. The servo-actuated ignition switch includes a first switching element operated by the ignition servo and a second switching element selectively connected to or disconnected from the first switching element. The signal receiver receives electromagnetic waves, and the manually operated ignition signal transmitter transmits electromagnetic waves. In a second embodiment, a receiver-tilt servo is controlled by the signal receiver. A manually operated tilt signal transmitter is actuated to transmit signals for activation of the receiver-tilt servo. A tilting assembly is connected between the receiver-tilt servo and the fireworks receiver assembly. A pivot assembly is connected between the housing assembly and the fireworks receiver assembly. The receiver-tilt servo receives electromagnetic waves, and the manually operated tilt signal transmitter transmits electromagnetic waves.

6 Claims, 2 Drawing Sheets

REMOTELY-ACTUATED FIREWORKS LAUNCHER APPARATUS

BACKGROUND OF THE INVENTION

1. Field of the Invention

The present invention relates generally to fireworks and, more particularly, to devices especially adapted for launching fireworks.

2. Description of the Prior Art

Throughout the years, a number of innovations have been developed relating to launching fireworks, and the following U.S. patents are representative of some of those innovations: U.S. Pat. Nos. 4,325,304; 4,641,580; 4,771,695; 4,917,015; 5,282,455; and 5,339,741. More specifically, U.S. Pat. Nos. 4,325,304 and 4,641,580 disclose complex electronic circuity arrays for launching pyrotechnic devices. To avoid such complexities, it would be desirable if a fireworks launching device were provided which used simple electrical circuitry for launching fireworks.

U.S. Pat. Nos. 4,771,695, 4,917,015, 5,282,455, and 5,339,741 disclose physical structures for launching fireworks. All of the physical support structures are supported by the ground and are immobile. To add versatility to physical support structures, it would be desirable if a physical support structure for a fireworks launcher were mobile.

Still other features would be desirable in a fireworks launcher apparatus. The prior art devices disclosed above are all directly controlled. Since fireworks give off considerable heat, light, and smoke, it would be desirable if a fireworks launching device were remotely controlled.

Some remotely-controlled devices are controlled by long control wires. To avoid the inconvenience of long control wires, it would be desirable if a remotely-controlled fireworks launching device were controlled by electromagnetic waves.

Fireworks launching devices are primarily concerned with one function, that of launching fireworks. Once the fireworks are launched, the launching device performs no guidance function for the fireworks. In this respect, it would be desirable if a fireworks launching device also performed guidance functions. Moreover, it would be desirable if the guidance functions performed by the fireworks launching device were remotely controlled.

Thus, while the foregoing body of prior art indicates it to be well known to use fireworks launching devices, the prior art described above does not teach or suggest a remotely-actuated fireworks launcher apparatus which has the following combination of desirable features: (1) uses simple electrical circuitry for launching fireworks; (2) is mobile; (3) is remotely controlled; (4) is controlled by electromagnetic waves; (5)performs guidance functions; and (6) performs guidance functions by remote control. The foregoing desired characteristics are provided by the unique remotely-actuated fireworks launcher apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a remotely-actuated fireworks launcher apparatus which includes a housing assembly, a signal receiver housed within the housing assembly, an ignition servo electrically connected to the signal receiver and housed with the housing assembly, and a servo-actuated ignition switch operated by the ignition servo. The servo-actuated ignition switch is in an ignition circuit which also includes an electric igniter assembly, and a power supply. A fireworks receiver assembly is attached to the electric igniter assembly. The fireworks receiver assembly receives a fireworks device that is ignited by the electric igniter assembly. A manually operated ignition signal transmitter is actuated to transmit signals for activation of the signal receiver.

The servo-actuated ignition switch includes a first switching element operated by the ignition servo and a second switching element selectively connected to or disconnected from the first switching element.

The signal receiver receives electromagnetic waves, and the manually operated ignition signal transmitter transmits electromagnetic waves.

In a second embodiment of the invention, a receiver-tilt servo is controlled by the signal receiver. A manually operated tilt signal transmitter is actuated to transmit signals for activation of the receiver-tilt servo. A tilting assembly is connected between the receiver-tilt servo and the fireworks receiver assembly. A pivot assembly is connected between the housing assembly and the fireworks receiver assembly. The receiver-tilt servo receives electromagnetic waves, and the manually operated tilt signal transmitter transmits electromagnetic waves.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remotely actuated fireworks launcher apparatus which has all of the advantages of the prior art and none of the disadvantages.

It is another object of the present invention to provide a new and improved remotely-actuated fireworks launcher apparatus which may be easily and efficiently manufactured and marketed.

It is a further object of the present invention to provide a new and improved remotely-actuated fireworks launcher apparatus which is of durable and reliable construction.

An even further object of the present invention is to provide a new and improved remotely-actuated fireworks launcher apparatus which is susceptible of a low cost of manufacture with regard to both materials and labor, and which accordingly is then susceptible of low prices of sale to the consuming public, thereby making such remotely-actuated fireworks launcher apparatus available to the buying public.

Still yet a further object of the present invention is to provide a new and improved remotely-actuated fireworks launcher apparatus which uses simple electrical circuitry for launching fireworks.

Still another object of the present invention is to provide a new and improved remotely-actuated fireworks launcher apparatus that is mobile.

Yet another object of the present invention is to provide a new and improved remotely-actuated fireworks launcher apparatus which is remotely controlled.

Even another object of the present invention is to provide a new and improved remotely-actuated fireworks launcher apparatus that is controlled by electromagnetic waves.

Still a further object of the present invention is to provide a new and improved remotely-actuated fireworks launcher apparatus which performs guidance functions.

Yet another object of the present invention is to provide a new and improved remotely-actuated fireworks launcher apparatus that performs guidance functions by remote control.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved remotely-actuated fireworks launcher apparatus embodying the principles and concepts of the present invention will be described.

Figure 1:
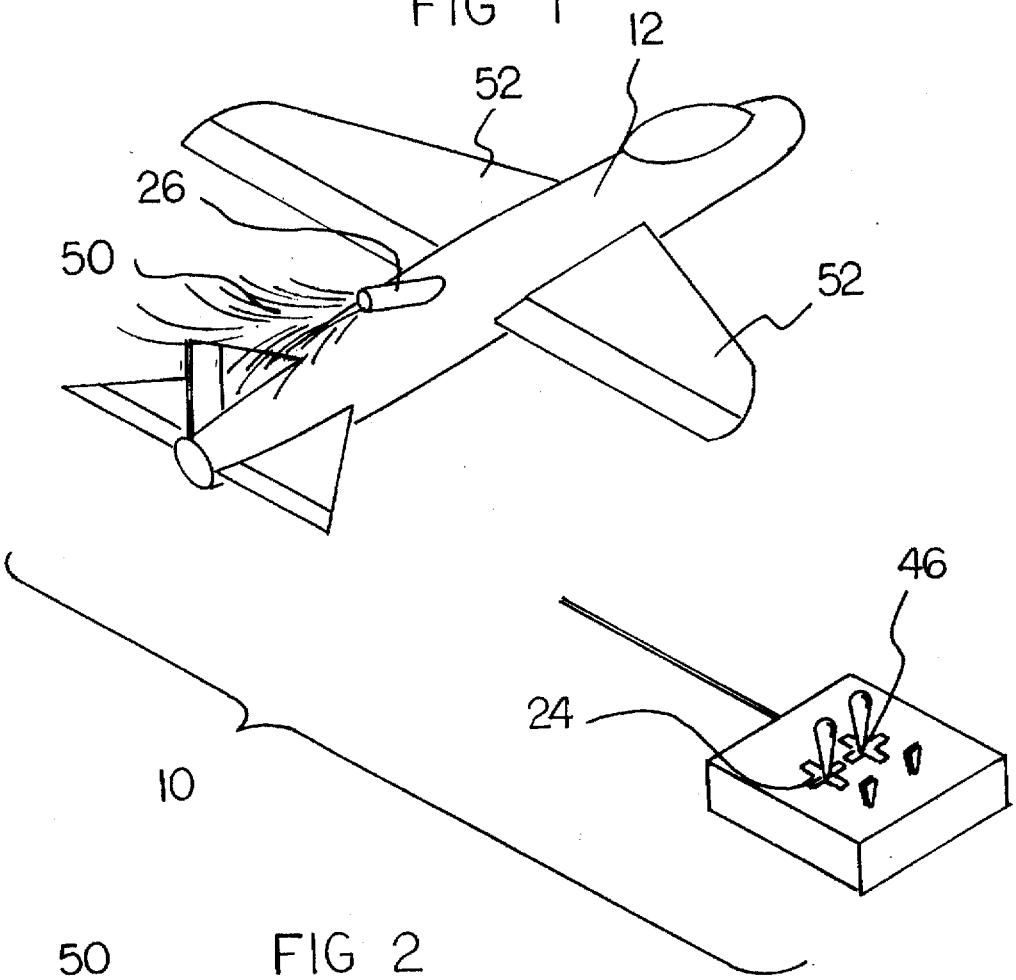
FIG. 1 is a perspective view showing a first embodiment of the remotely-actuated fireworks launcher apparatus of the invention which is remotely controlled by electromagnetic waves.
Figure 2:
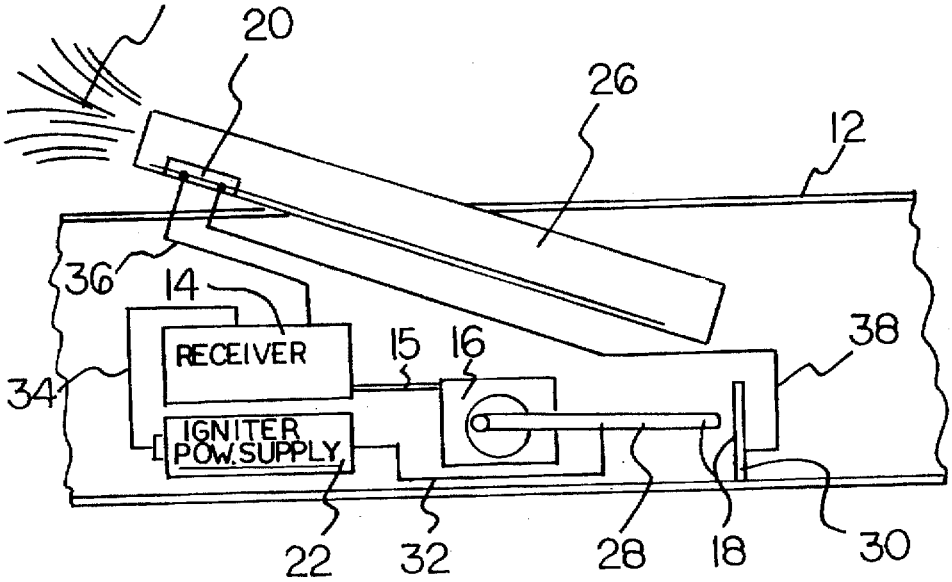
FIG. 2 is an enlarged, partially broken away portion of the remotely controlled fireworks launcher portion of the embodiment of the invention shown in FIG. 1.

Turning to FIGS. 1–2, there is shown a first embodiment of the remotely-actuated fireworks launcher apparatus of the invention generally designated by reference numeral 10. In its preferred form, remotely-actuated fireworks launcher apparatus 10 includes a housing assembly 12, a signal receiver 14 housed within the housing assembly 12, an ignition servo 16 electrically connected to the signal receiver 14 by a first conductor assembly 15 and housed with the housing assembly 12, and a servo-actuated ignition switch 18 operated by the ignition servo 16. The servo-actuated ignition switch 18 is in an ignition circuit which also includes an electric igniter assembly 20, and a power supply 22. A fireworks receiver assembly 26 is attached to the electric igniter assembly 20. The fireworks receiver assembly 26 receives a fireworks device that is ignited by the electric igniter assembly 20. A manually operated ignition signal transmitter 24 is actuated to transmit signals for activation of the signal receiver 14. The fireworks receiver assembly 26 is in the form of a tube having a closed end and an open end. The electric igniter assembly 20 is located at the open end of the tube. Hot gases 50 from the burning fireworks in the fireworks receiver assembly 26 exit from the open end of the tube, and a propulsive force pushes against the closed end of the tube.

The servo-actuated ignition switch 18 includes a first switching element 28 operated by the ignition servo 16 and a second switching element 30 selectively connected to or disconnected from the first switching element 28. The first switching element 28 is connected by conductor 32 to the power supply 22. The power supply 22 also powers the signal receiver 14 and is connected to the signal receiver 14 by conductor 34. The signal receiver 14 is connected to the electric igniter assembly 20 by conductor 36. The electric igniter assembly 20 is connected to the second switching element 30 by conductor 38. The first switching element 28 can be a metal rod 28 that is selectively moved toward and away from the second switching element 30 by the ignition servo 16. The second switching element 30 can be a metal plate, such as a steel plate 30.

The signal receiver 14 receives electromagnetic waves, and the manually operated ignition signal transmitter 24 transmits electromagnetic waves.

In using the first embodiment of the invention, a bottle rocket or Roman candle or other fireworks device is placed in the fireworks receiver assembly 26. An operator takes the ignition signal transmitter 24 and manually operates it. Electromagnetic waves are transmitted by the ignition signal transmitter 24 and are received by the signal receiver 14. The signal receiver 14 activates the ignition servo 16 which moves the first switching element 28 into contact with the steel plate 30. This completes the ignition circuit causing the electric igniter assembly 20 to ignite the fireworks in the fireworks receiver assembly 26. As the fireworks burns, hot gases 50 exit from the rear of the fireworks receiver assembly 26.

Figure 3:
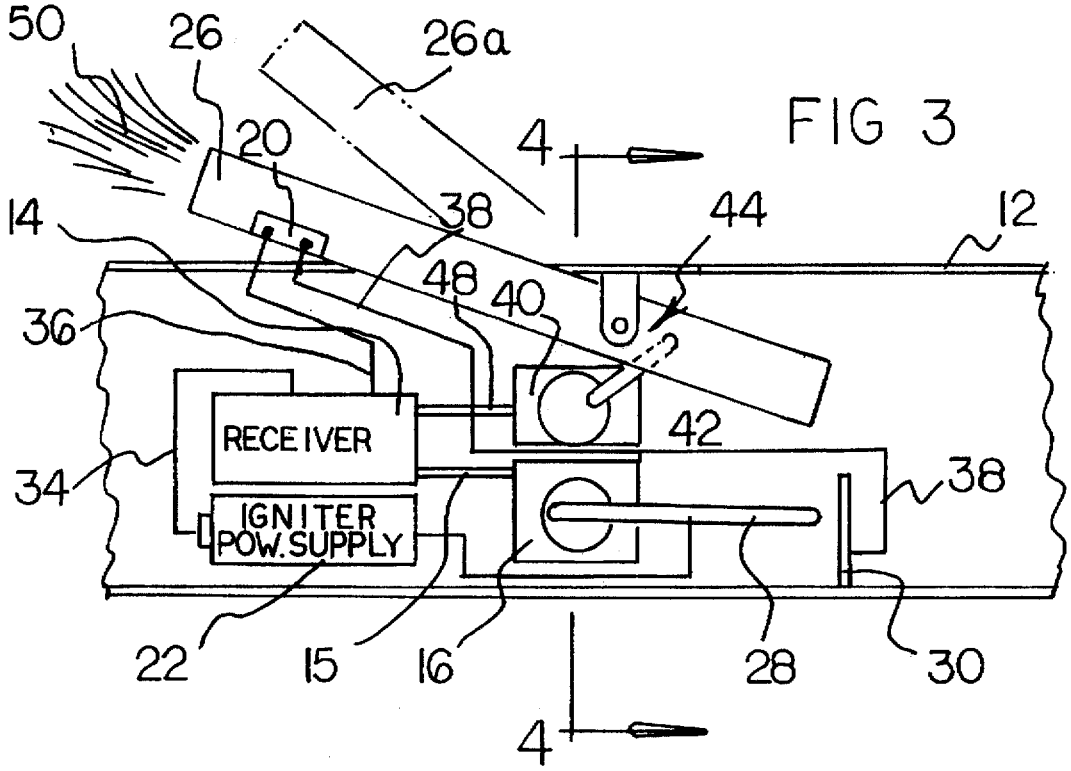
FIG. 3 is a partially broken away portion of a fireworks launcher portion of a second embodiment of the remotely-actuated fireworks launcher apparatus of the invention which includes a remotely controlled guidance control.
Figure 4:
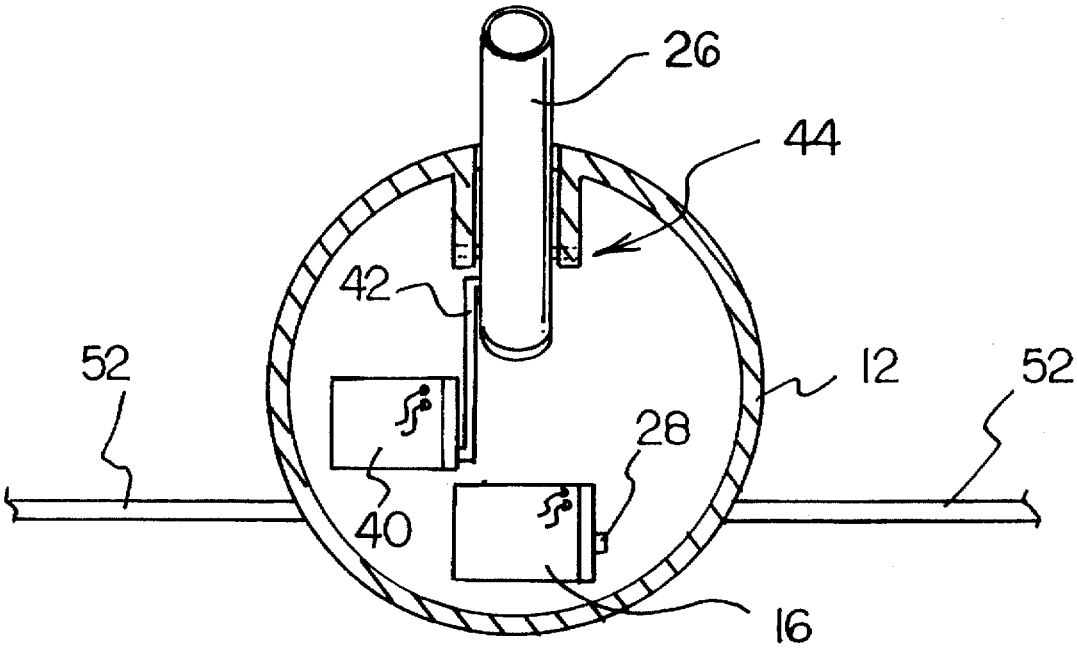
FIG. 4 is an enlarged cross-sectional view of the embodiment of the invention shown in FIG. 3 taken along line 4—4 of FIG. 3.

Turning to FIGS. 3 and 4, a second embodiment of the invention is shown. Reference numerals are shown that correspond to like reference numerals that designate like elements shown in the other figures. In addition, a receiver-tilt servo 40 is controlled by the signal receiver 14. A manually operated tilt signal transmitter 46 (shown in FIG. 1) is actuated to transmit signals for activation of the receiver-tilt servo 40. A tilting assembly is connected between the receiver-tilt servo 40 and the fireworks receiver assembly 26. A pivot assembly 44 is connected between the housing assembly 12 and the fireworks receiver assembly 26. The receiver-tilt servo 40 receives electromagnetic waves, and the manually operated tilt signal transmitter 46 transmits electromagnetic waves.

In using the second embodiment of the invention, the manually operated ignition signal transmitter 24 is operated in the usual way to control ignition of the electric igniter assembly 20. In addition, when the manually operated tilt signal transmitter 46 is activated, the signal receiver 14 is connected to a second conductor assembly 48 and sends a signal to the receiver-tilt servo 40 which moves the tilting assembly. The fireworks receiver assembly 26 is pushed by the tilting assembly to move around the pivot assembly 44. When the fireworks receiver assembly 26 is tilted as shown in broken lines as fireworks receiver assembly 26*a*, the hot gases 50 that exit from the rear of the fireworks receiver assembly 26 are redirected, causing the direction of movement of the housing assembly 12 to be redirected. The tilting assembly is pivoted at one end on the receiver-tilt servo 40 and at the other end on the fireworks receiver assembly 26.

As shown in FIG. 1, the housing assembly 12 is in the form of an airplane that has wings 52 and the fire works receiver assembly tube 26 exits from the top of the airplanes's fuselage. The assembly 26 may alternatively point downwardly below the tail section of the fuselage as this will help to direct the heat of the explosive away from the surface of the airplane. Other possible forms of the housing assembly 12 are also contemplated. For example, the housing assembly 12 can also be in the form of a helicopter, an automobile, and a boat, among others.

The signal receiver 14, the ignition servo 16, the receiver-tilt servo 40, the manually operated ignition signal transmitter 24, and the manually operated tilt signal transmitter 46 can be conventional devices such as are conventionally used in remotely-controlled airplanes, boats, and the like. In addition, it will be appreciated that the foregoing internal components as well as the first and second switching elements 28, 30, 38, etc. may advantageously be mounted on a replaceable circuit board module suitably fixedly supported within the interior of the housing assembly as will be obvious to a person of ordinary skill in the art.

The components of the remotely-actuated fireworks launcher apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved remotely-actuated fireworks launcher apparatus that is low in cost, relatively simple in design and operation, and which may advantageously uses simple electrical circuitry for launching fireworks. With the invention, a remotely-actuated fireworks launcher apparatus is provided which is mobile. With the invention, a remotely-actuated fireworks launcher apparatus is provided which is remotely controlled. With the invention, a remotely-actuated fireworks launcher apparatus is provided which is controlled by electromagnetic waves. With the invention, a remotely-actuated fireworks launcher apparatus is provided which performs guidance functions. With the invention, a remotely-actuated fireworks launcher apparatus is provided which performs guidance functions by remote control.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A remotely-actuated fireworks launcher apparatus, comprising:

a housing assembly, an signal receiver housed within said housing assembly, an ignition servo electrically connected to said signal receiver and housed with said housing assembly, a servo-actuated ignition switch operated by said ignition servo, wherein said servo-actuated ignition switch is in an ignition circuit which also includes an electric igniter assembly, and a power supply, a fireworks receiver assembly attached to said electric igniter assembly, wherein said fireworks receiver assembly receives a fireworks device that is ignited by said electric igniter assembly, and a manually operated ignition signal transmitter which is actuated to transmit signals for activation of said signal receiver, further including:

a receiver-tilt servo controlled by said signal receiver, a manually operated tilt signal transmitter which is actuated to transmit signals for activation of said receiver-tilt servo, a tilting assembly connected between said receiver-tilt servo and said fireworks receiver assembly, and a pivot assembly, connected between said housing assembly and said fireworks receiver assembly.

2. The apparatus of claim 1 wherein said servo-actuated ignition switch includes a first switching element operated by said ignition servo and a second switching element selectively connected to or disconnected from said first switching element.

3. The apparatus of claim 1 wherein said fireworks receiver assembly is in a form of a tube having a closed end and an open end.

4. The apparatus of claim 3 wherein said electric igniter assembly is located at said open end of said tube.

5. The apparatus of claim 1 wherein said signal receiver receives electromagnetic waves, and said manually operated ignition signal transmitter transmits electromagnetic waves.

6. The apparatus of claim 1 wherein said receiver-tilt servo receives electromagnetic waves and said manually operated tilt signal transmitter transmits electromagnetic waves.

* * * * *